US006074230A

United States Patent [19]

Comerci et al.

[11] Patent Number: 6,074,230

[45] Date of Patent: Jun. 13, 2000

[54] HERMAPHRODITIC ELECTRICAL CONNECTORS

[75] Inventors: Joseph D. Comerci, Elmhurst; Kirk B. Peloza, Naperville, both of Ill.

[73] Assignee: Molex Incorporated, Lisle, Ill.

[21] Appl. No.: 09/046,252

[22] Filed: Mar. 23, 1998

[51] Int. Cl.[7] ..... H01R 13/28

[52] U.S. Cl. ..... 439/284; 439/862

[58] Field of Search ..... 439/284, 289, 439/660, 862

[56] References Cited

U.S. PATENT DOCUMENTS

| | | | |
|---|---|---|---|
| 3,601,759 | 8/1971 | Barker | 339/59 M |
| 3,638,164 | 1/1972 | Glance et al. | 339/49 |
| 3,827,007 | 7/1974 | Fairbairin et al. | 339/49 R |
| 4,266,845 | 5/1981 | Ishikawa | 339/176 MP |
| 4,657,320 | 4/1987 | Bamford et al. | 339/4 |
| 4,701,133 | 10/1987 | Worth | 439/13 |
| 4,737,118 | 4/1988 | Lockard | 439/289 |
| 4,975,062 | 12/1990 | Evans et al. | 439/13 |
| 5,098,311 | 3/1992 | Roath et al. | 439/289 |
| 5,112,243 | 5/1992 | Chow et al. | 439/352 |
| 5,183,409 | 2/1993 | Clever et al. | 439/291 |
| 5,199,884 | 4/1993 | Kaufman et al. | 439/74 |
| 5,498,167 | 3/1996 | Seto et al. | 439/74 |
| 5,520,545 | 5/1996 | Sipe | 439/65 |
| 5,575,674 | 11/1996 | Davis et al. | 439/284 |
| 5,921,787 | 7/1999 | Pope et al. | 439/74 |

*Primary Examiner*—Neil Abrams
*Assistant Examiner*—Chandrika Prasad
*Attorney, Agent, or Firm*—Stephen Z. Weiss

[57] ABSTRACT

An electrical connector assembly includes a pair of hermaphroditic connectors having opposed mating faces which are juxtaposed generally along a plane when the connectors are mated. The connectors are adapted for mating in either opposite direction generally parallel to the plane of the mating faces. Each connector includes a housing having a plurality of spaced-apart ribs defining respective grooves between adjacent ribs. The ribs of each connector are interleaved with the ribs of the other connector when the two connectors are mated. The housing of each connector includes complementary interengaging latches to lock the connectors against unmating in a direction generally perpendicular to the plane of the mating faces. A plurality of terminals are mounted on each housing and have contact portions of at least some of the terminals between the ribs for engaging the contact portions of the terminals on the housing of the other connector.

30 Claims, 7 Drawing Sheets

HERMAPHRODITIC ELECTRICAL CONNECTORS

FIELD OF THE INVENTION

This invention generally relates to the art of electrical connectors and, particularly, to an electrical connector assembly comprising a pair of hermaphroditic electrical connectors.

BACKGROUND OF THE INVENTION

Generally, an electrical connector includes some form of dielectric or insulating housing which mounts one or more conductive electrical terminals. The terminals have contact portions which are adapted for engaging the contact portions of the terminals of a complementary mating electrical connector or other connecting device. In an electrical connector assembly, a pair of mating connectors are interconnected for establishing one or more electrical circuits through the assembly interface.

Electrical connectors are used in a wide variety of applications. They may interconnect discrete electrical wires or they may interconnect a plurality of printed circuit boards or they may interconnect discrete wires with circuit traces on a circuit board, for instance. Electrical connectors also are used in a wide variety of environments, such as through panels or backplanes as well as in "drawer" applications, for instance.

In many applications, interconnecting electrical connectors are complex and expensive, involving one type of connector (such as a male or plug connector) and still another type of connector (such as a receptacle connector). In some instances, a pair of hermaphroditic connectors are used in an electrical connector assembly to simplify the assembly and reduce its cost. The present invention is directed to designs for providing simple, inexpensive and effective hermaphroditic electrical connectors.

SUMMARY OF THE INVENTION

An object, therefore, of the invention is to provide a new and improved electrical connector assembly including a pair of hermaphroditic connectors.

In the exemplary embodiment of the invention, the pair of hermaphroditic connectors have opposed mating faces which are juxtaposed generally along a plane when the connectors are mated. The connectors are adapted for mating in either opposite direction generally parallel to the plane of the mating faces.

Each hermaphroditic connector includes a housing having a plurality of spaced-apart ribs with edges and with respective grooves between immediately adjacent ribs. The ribs of each hermaphroditic connector are interleaved with the ribs of the other connector when the two connectors are mated. Complementary interengaging latch means are provided on the housing to lock the connectors against unmating in a direction generally perpendicular to the plane of the mating faces. A plurality of terminals are mounted on each housing and have contact portions of at least some of the terminals between the ribs for engaging the contact portions of the terminals on the housing of the other connector.

As disclosed herein, the complementary interengaging latch means are provided by a hook on the housing of each hermaphroditic connector engageable with a complementary flange on the housing of the other connector. The hook is at one end of the mating face of each connector, and the flange is at an opposite end of the respective mating face.

In one embodiment of the invention, alternating ones of the terminals have contact portions located on the edges of the ribs. The contact portions of the other alternating terminals are located in the grooves. The terminals are stamped and formed of sheet metal material, and the contact portions are flexible and bowed outwardly relative to the plane of the mating faces. Anti-overstress portions of the housing may be provided behind the flexible contact portions of the terminals.

In a second embodiment of the invention, the ribs are bifurcated to define slots for receiving contact portions of alternating ones of the terminals. The contact portions of the other alternating terminals are located in the grooves between the bifurcated ribs. As disclosed herein, the contact portions of the alternating ones of the terminals are flexible, and the contact portions of the other of the alternating terminals are rigid.

The invention contemplates a unique configuration of hermaphroditic terminals. These terminals are shown in the second embodiment of the invention. Specifically, the terminals are identical, with flexible contact portions being at one end of the terminals and rigid contact portions being at another end of the terminals. Therefore, the terminals may be alternatingly oriented in opposite directions in the housing. As disclosed herein, the identical terminals are stamped from sheet metal material, with the rigid contact portions comprising edges of the stamped terminals and the flexible contact portions comprising stamped spring arms.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
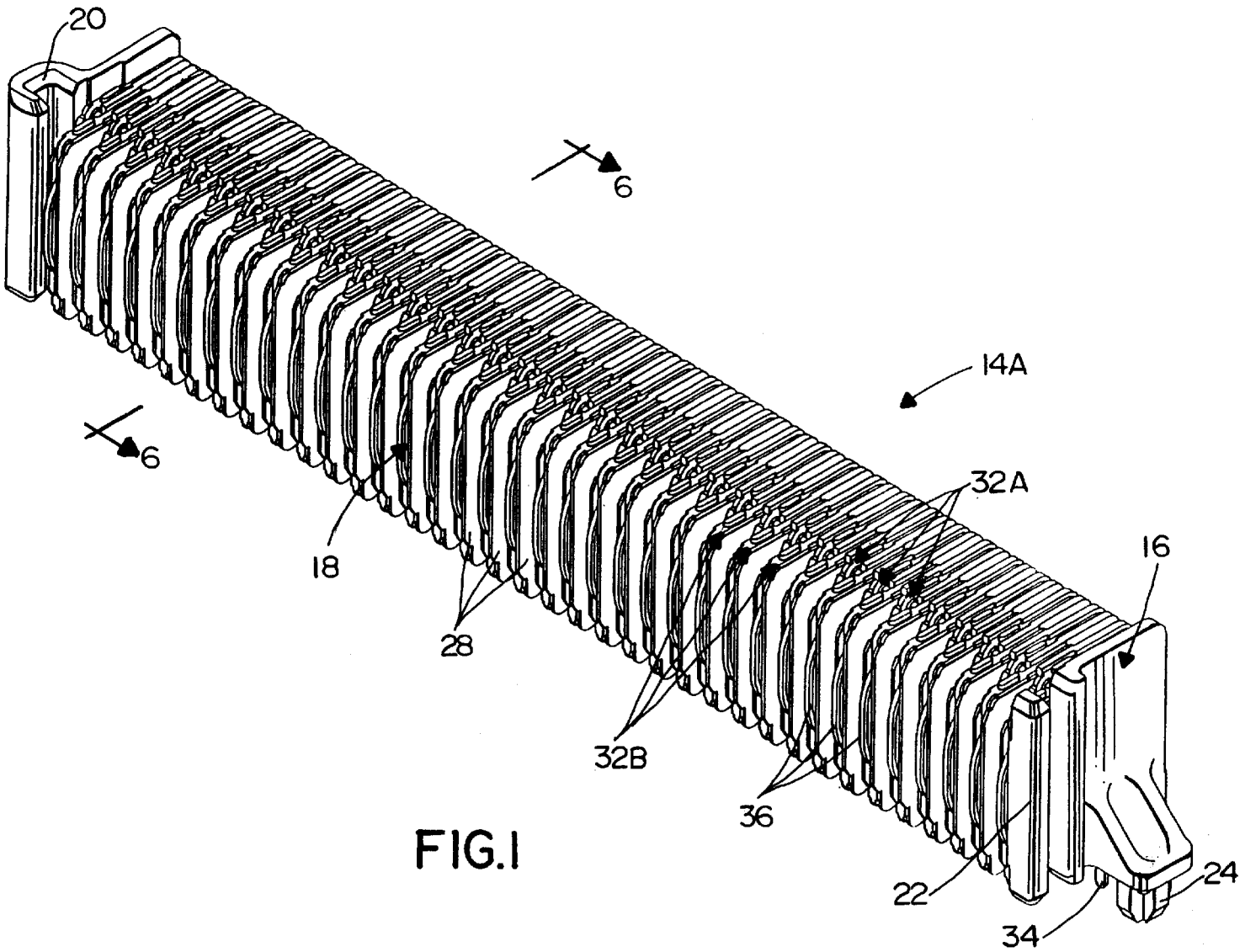
FIG. 1 is a perspective view of a first embodiment of a hermaphroditic connector according to the invention.

Referring to the drawings in greater detail, FIGS. 1–6 show a first embodiment of a hermaphroditic electrical connector, generally designated 14A, and FIGS. 7–12 show a second embodiment of a hermaphroditic electrical connector, generally designated 14B, according to the concepts of the present invention. Both embodiments are shown herein for creating an electrical connector assembly including a pair of the respective hermaphroditic connectors. Both embodiments are shown herein as adapted for interconnecting pairs of printed circuit boards. However, it should be understood that the concepts of the invention are not limited to circuit board applications. The connectors can be used in a wide variety of other applications, including panel or backplane applications as well as "drawer" applications, for instance.

Figure 2:
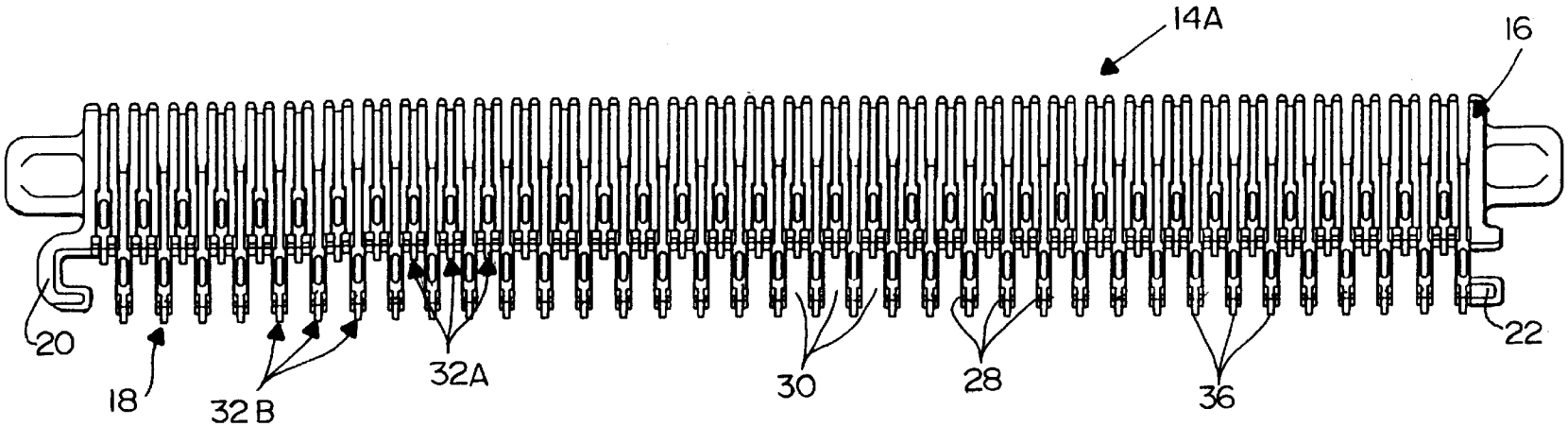
FIG. 2 is a top plan view of the connector of FIG. 1.
Figure 3:
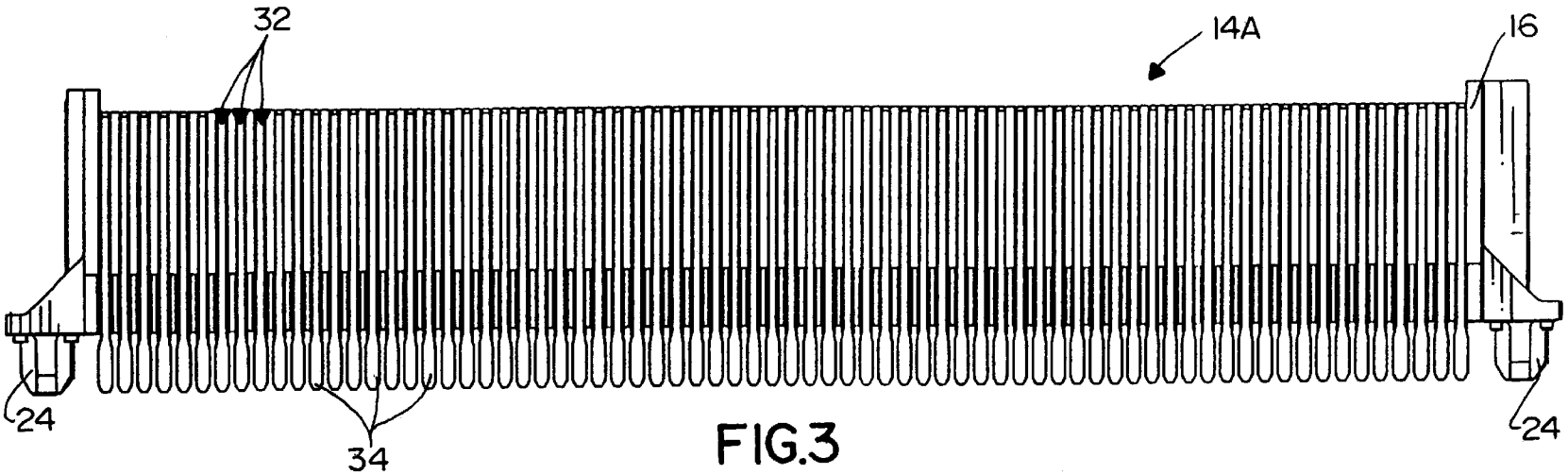
FIG. 3 is a rear elevational view of the connector of FIG. 1.
Figure 4:
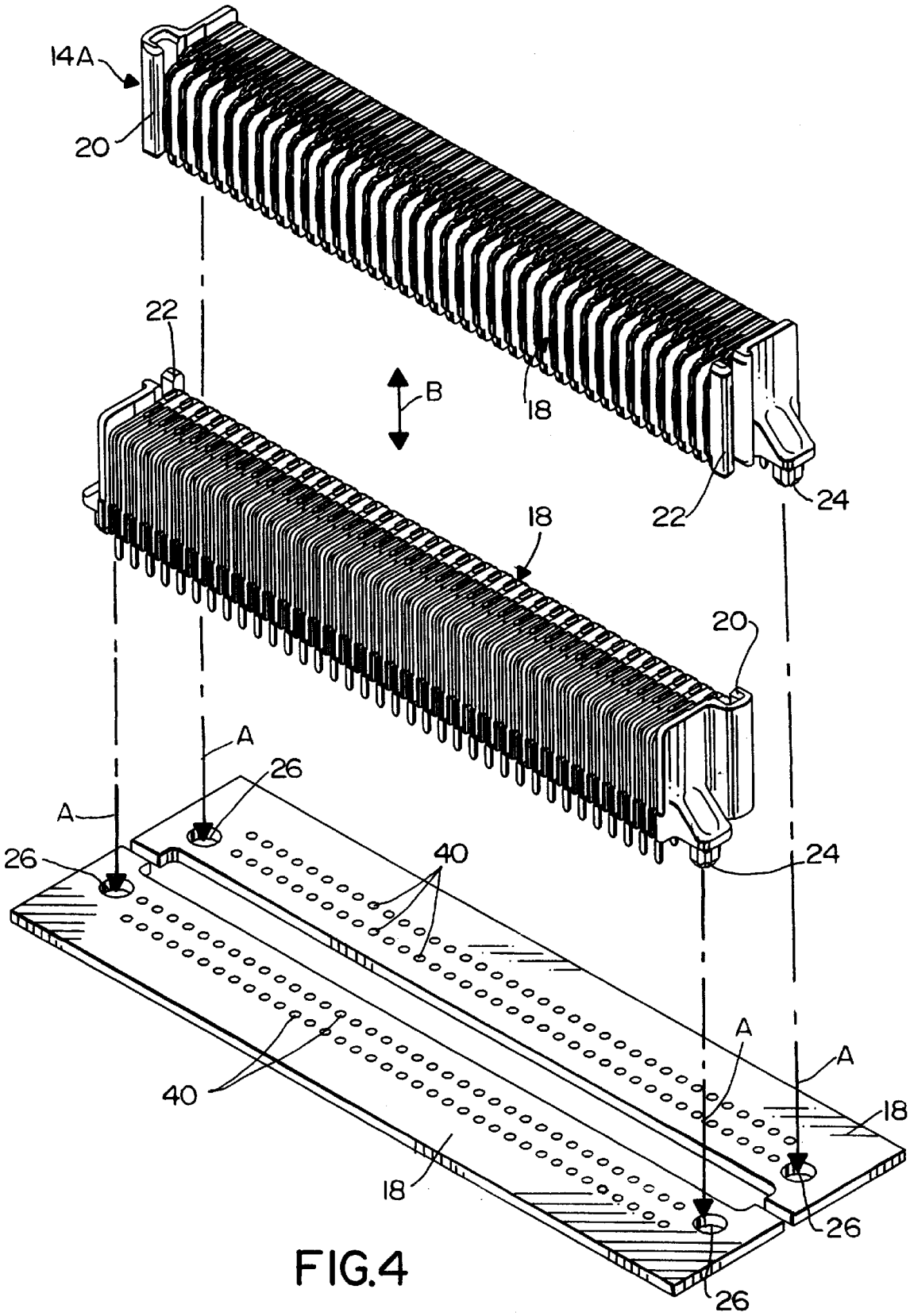
FIG. 4 is a perspective view of a pair of the hermaphroditic connectors of FIG. 1 in conjunction with a pair of printed circuit boards.

Referring first to FIGS. 1–3, hermaphroditic connector 14A includes an elongated dielectric housing, generally designated 16, defining a mating face, generally designated 18, whereby the mating faces of a pair of the connectors are juxtaposed generally along a plane when the connectors are mated. For instance, FIG. 4 shows a pair of connectors 14A adapted for mounting on a pair of printed circuit boards 18 in the direction of arrows "A". Therefore, the plane of the juxtaposed mating faces 18 are generally parallel to each other and perpendicular to the circuit boards. The connectors are adapted for mating in either opposite direction as indicated by double-headed arrow "B", generally parallel to the plane of mating faces 18.

Generally, complementary interengaging latch means are provided on housing 16 of each connector 14A to lock a pair of the connectors against unmating in a direction generally perpendicular to the plane of mating faces 18. More particularly, as best seen in FIGS. 1 and 2, the complementary interengaging latch means are provided by a hook 20 at one end of the elongated housing for embracing a flange 22 at the opposite end of the housing of the mating connector. FIGS. 1 and 3 show that a pair of mounting posts 24 depend from opposite ends of the housing for insertion into appropriate mounting holes 26 (FIG. 4) in printed circuit boards 18.

As best seen in FIGS. 1 and 2, housing 16 includes a plurality of spaced-apart ribs 28 defining respective grooves 30 between immediately adjacent ribs. The ribs of each hermaphroditic connector in a pair of connectors are interleaved with the ribs of the other connector when the two connectors are mated. Each rib has an edge 28*a* as seen in FIG. 6.

Generally, a plurality of terminals, generally designed 32, are mounted on housing 16. As will be seen hereinafter, alternating ones of the terminals have contact portions located at edges 28*a* of ribs 28, with the contact portions of the other alternating terminals being located in grooves 30.

Figure 5:
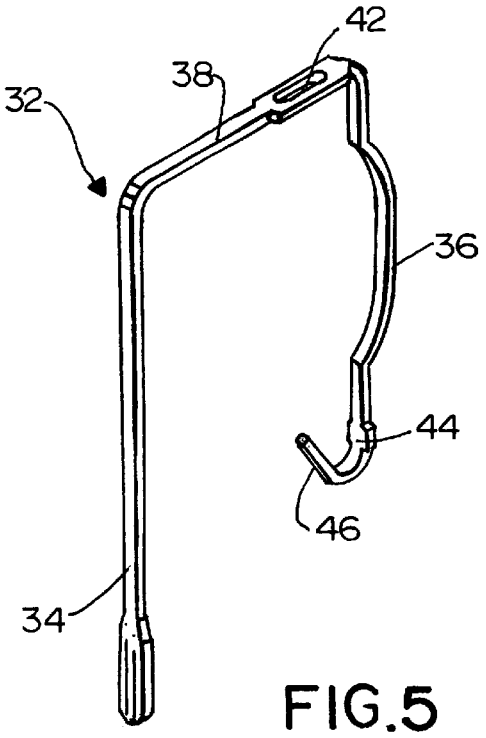
FIG. 5 is a perspective view of one of the terminals of the connector of FIG. 1.

Referring to FIG. 5, each terminal 32 is stamped and formed of sheet metal material. Each terminal is generally U-shaped to define first and second legs 34 and 36, respectively, joined by a cross or bight portion 38. Leg 34 defines a solder tail for insertion into a respective one of a plurality of holes 40 (FIG. 4) in one of the printed circuit boards for solder connection to a circuit trace on the board and/or in the hole. Leg 36 defines an outwardly bowed contact portion of the terminal. Cross portion 38 has an aperture 42 for mounting the terminal on the housing, as described hereinafter. The leg which defines contact portion 36 also includes a widened press-fit section 44 near a distal end 46 which is upturned to facilitate mounting the terminal in the housing.

Figure 6:
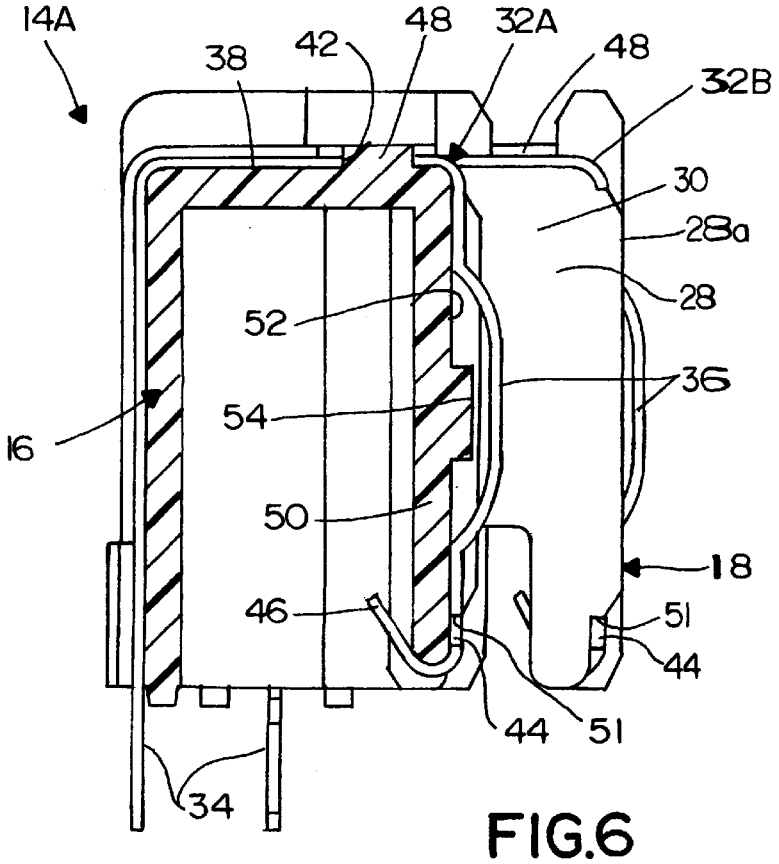
FIG. 6 is a vertical section taken generally along line 6—6 of FIG. 1.

FIG. 6 shows a pair of the terminals mounted in one of the grooves 30 and on one of the ribs 28. Although the terminals are identical, the terminals have been referenced as terminal 32A which is mounted so that its contact portion 36 is located in one of the grooves 30, and the other terminal is referenced 32B with its contact portion 36 disposed at edge 28*a* of one of the ribs 28.

More particularly, terminal 32A (FIG. 6) is mounted on housing 16 with a boss portion 48 of the housing projecting upwardly through aperture 42 in cross portion 38 of the terminal. The housing is molded of dielectric material such as plastic or the like, and boss portion 48 can be cold staked about the aperture in another embodiment not shown, a portion of the terminal is press fit into a slot in the connector housing. Upturned distal end 46 of the terminal embraces the lower edge of a wall 50 of the housing. The enlarged section 44 of the terminal fits against the front of wall 50 under shoulder 51 formed in ribs 28. It can be seen that contact portion 36 is bowed outwardly relative to the plane of mating face 18 of the connector. The housing includes an anti-overstress boss 54 behind contact portion 36 of terminal 32A, to prevent over-travel of the contact portion rearwardly toward the housing. Finally, solder tail 34 of terminal 32A can be seen in FIG. 6 projecting below housing 16 for insertion into its hole in the printed circuit board.

Terminal 32B is mounted on housing 16 substantially identical to the mounting of terminal 32A (FIG. 6) except that terminal 32B is mounted at edge 28*a* of one of the ribs 28. The housing includes one of the cold-staking bosses 48 and one of the anti-overstress bosses 54 for terminal 32B. Contact portion 36 of terminal 32B bows outwardly from a trough 52 in the edge of the rib and outwardly beyond mating face 18 of the connector.

From the above description of identical terminals 32A and 32B in reference to FIG. 6, it can be understood that the terminals alternate along the length of housing 16 in grooves 30 and at the edges of ribs 28 lengthwise of the housing. When a pair of the hermaphroditic connectors are mated, ribs 28 of one of the connectors project into grooves 30 of the other connector to interleave the ribs such that the contact portions 36 of terminals 32B engage contact portions 36 of terminals 32A. With the terminals 32A, 32B alternating lengthwise of the housing, it also can be understood from FIG. 6 that the lateral position of solder tails 34 also alternate along the length of the housing so that the solder tails are insertable into two rows of holes 40 in one of the printed circuit boards 18 as described above in relation to FIG. 4.

Figure 7:
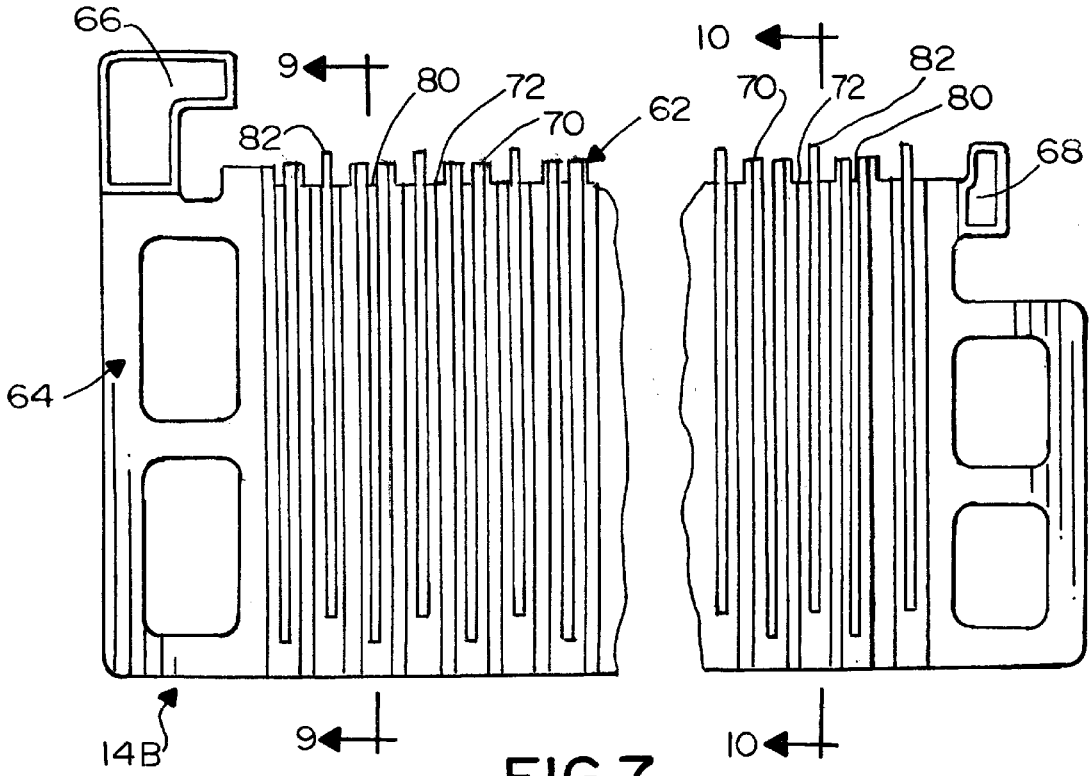
FIG. 7 is a fragmented top plan view of a second embodiment of a hermaphroditic electrical connector according to the invention.
Figure 8:
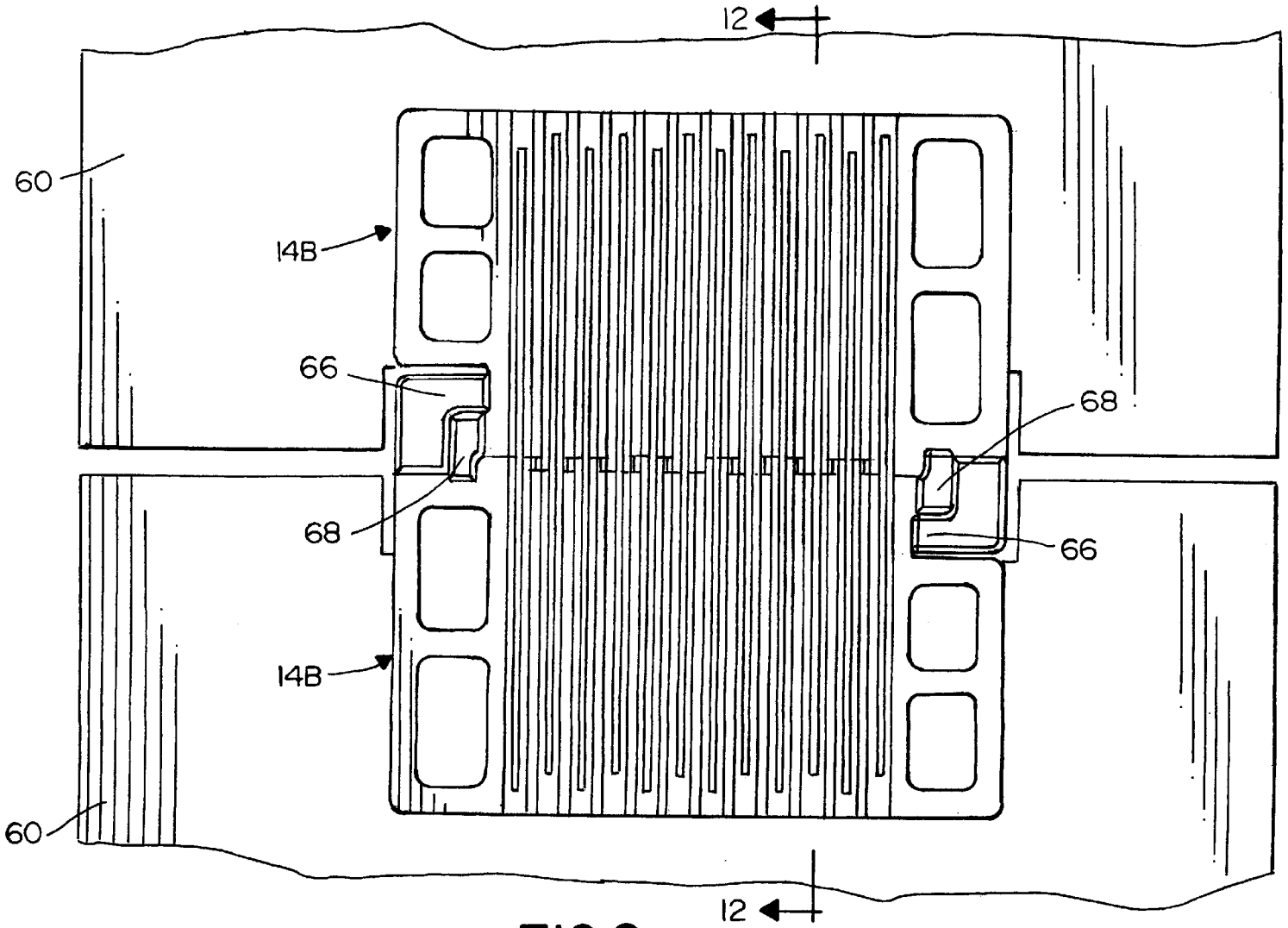
FIG. 8 is a top plan view of a pair of the hermaphroditic connectors of FIG. 7 interconnected and mounted on a pair of printed circuit boards.

As stated above, FIGS. 7–12 show a second form of hermaphroditic electrical connector, generally designated 14B. Again, a pair of hermaphroditic connectors 14B are adapted for mating in a connector assembly as shown in FIG. 8 to interconnect a pair of printed circuit boards 60, although the concepts of the invention are not limited to circuit board applications. Each hermaphroditic connector has a mating face 62 (FIG. 7) which is juxtaposed with the mating face of the other connector generally along a plane perpendicular to the circuit boards when the connectors are mated.

As with connector 14A, hermaphroditic connector 14B includes an elongated dielectric housing, generally designated 64, molded of insulating material such as plastic or the like. The housing includes complementary interengaging latch means in the form of a hook 66 and a flange 68 to lock the connectors against unmating in a direction generally perpendicular to the plane of the mating faces of the connectors. The hooks and flanges of a pair of the mating connectors are shown interengaged in FIG. 8. The housing includes a plurality of spaced apart ribs 70 (FIG. 7) defining respective grooves 72 between immediately adjacent ribs. As seen in FIG. 8, the ribs of each hermaphroditic connector 14B are interleaved with ribs of the other connector when the two connectors are mated.

Figure 9:
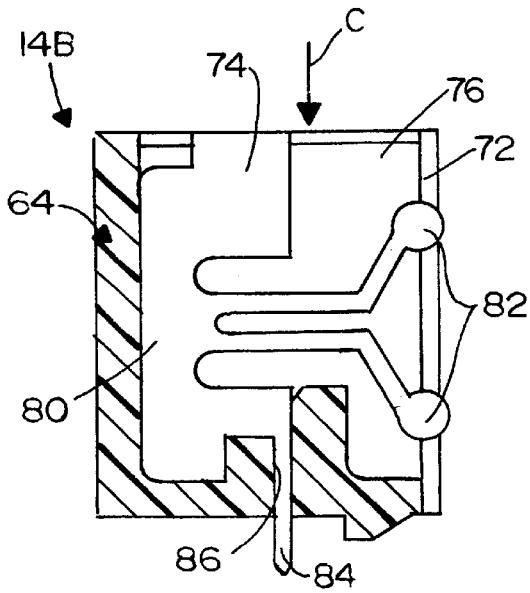
FIG. 9 is a vertical section taken generally along line 9—9 of FIG. 7.
Figure 10:
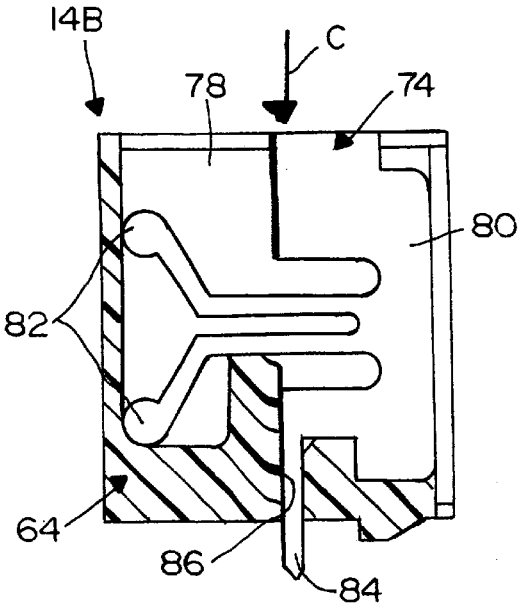
FIG. 10 is a vertical section taken generally along line 10—10 of FIG. 7.

FIGS. 9 and 10 show a plurality of terminals, generally designated 74, which are mounted on housing 64 of each hermaphroditic connector 14B. Generally, the terminals are disposed on the housing with flexible and rigid contact portions alternating longitudinally of the housing. More particularly, each terminal 74 is identical and is stamped from conductive sheet metal material. Each terminal is inserted in the direction on arrows "C" (FIGS. 9 and 10) into narrow cavities 76 (FIG. 9) and 78 (FIG. 10). Each terminal includes a rigid contact portion 80 and a flexible contact portion defined by a pair of spring arms 82. Each terminal also includes a solder tail 84 which projects through a hole 86 in the housing for insertion into a hole in an appropriate printed circuit board for solder connection to a circuit trace on the board and/or in the hole.

Referring to FIGS. 9 and 10 in conjunction with FIG. 7, each cavity 76 (FIG. 9) communicates with one of the grooves 72 between a pair of immediately adjacent ribs 70 so that flexible contact portions or spring arms 82 project outwardly of the housing within grooves 72 as seen in FIG. 7. On the other hand, each cavity 78 (FIG. 10) communicates through the edge of one of the ribs 70 so that the rib is bifurcated, with rigid contact portion 80 recessed within the edge of the rib. Therefore, when a pair of the hermaphroditic connectors 14B are mated as shown in FIG. 8, with bifurcated ribs 70 of each connector projecting into grooves 72 of the other connector, outwardly projecting spring contact arms 82 of one of the connectors enter the recessed edges of ribs 70 and into engagement with rigid contact portions 80 of the other connector.

In comparing FIGS. 9 and 10, it can be understood that a single stamped terminal configuration 74 can provide a "rigid" terminal as well as a "flexible" terminal simply by orienting the terminal in opposite directions within housing 64 of hermaphroditic connector 14B. In essence, the terminals are disposed in alternating orientations within alternating cavities 76 and 78 so that the flexible and rigid contact portions of the terminals alternate lengthwise of the connector housing.

Figure 11:
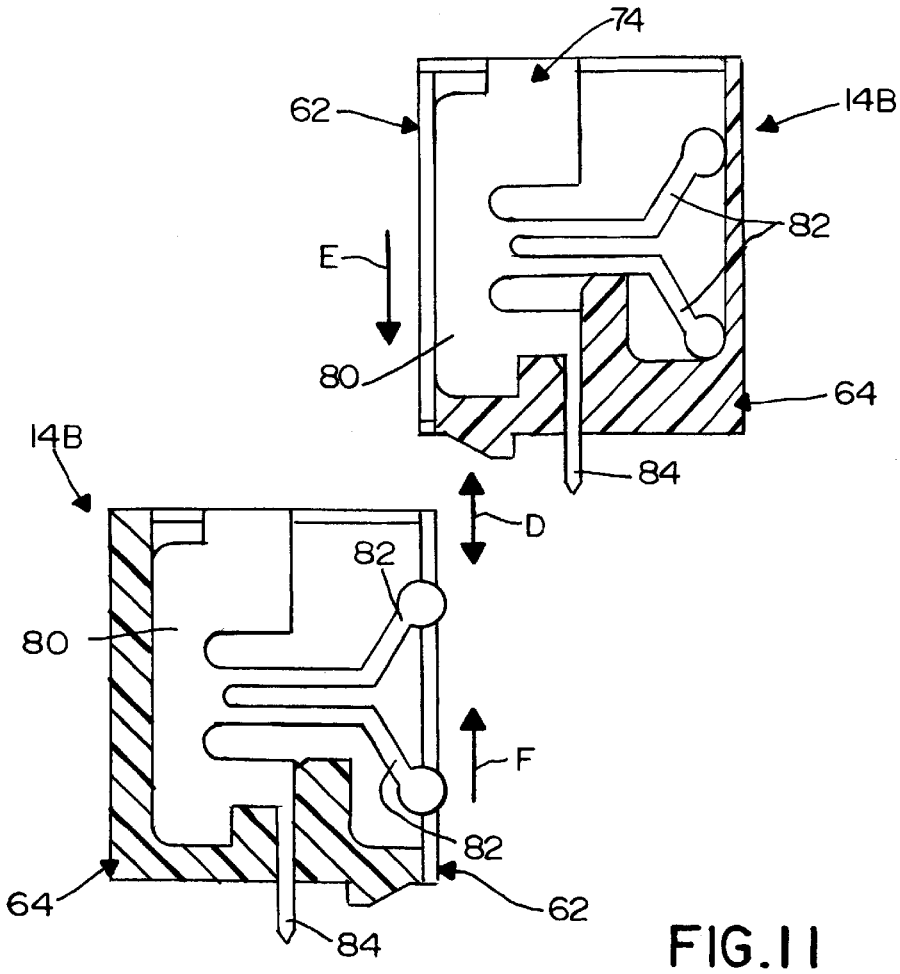
FIG. 11 is a section through a pair of the connectors of FIG. 7 about to be mated in one direction generally parallel to the mating faces of the connectors.

FIG. 11 shows a pair of the hermaphroditic electrical connectors 14B to depict how the connectors are mated in either opposite direction generally parallel to the mating faces 62 of the connectors as indicated by double-headed arrow "D". More particularly, the top/right connector in FIG. 11 can be moved downwardly in the direction of arrow "E" for mating with the bottom/left connector. Conversely, the bottom/left connector can be moved upwardly in the direction of arrow "F" to mate the connectors and interconnect the circuit boards in a coplanar configuration as seen in FIG. 8. Of course, both connectors can be moved simultaneously in the direction of arrows "E" and "F" for mating purposes to interconnect the circuit boards.

Figure 12:
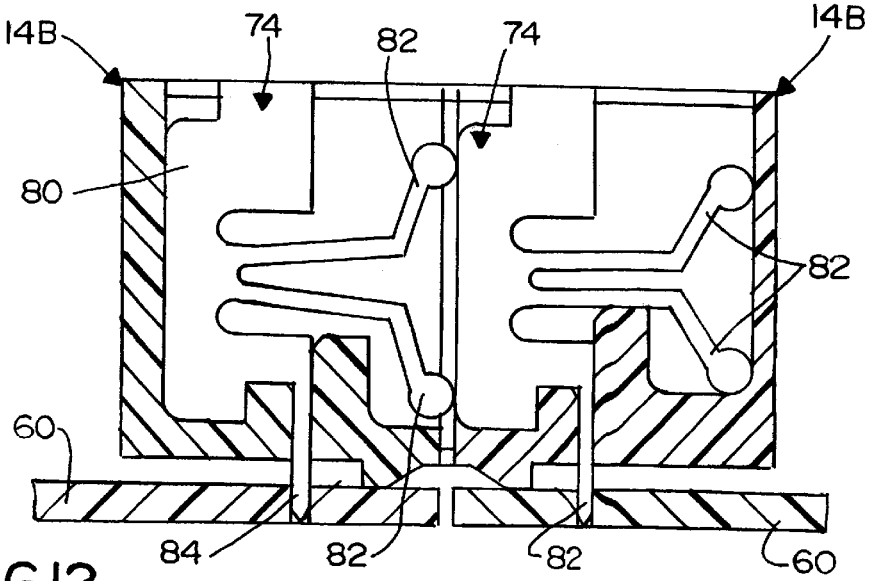
FIG. 12 is a view similar to that of FIG. 11, but with the connectors mated, such as along line 12—12 of FIG. 8.

Finally, FIG. 12 shows the pair of hermaphroditic connectors 14B in mated condition interconnecting printed circuit boards 60. It can be seen that rigid contact portion 80 of the right-hand terminal 74 has engaged and biased outwardly the flexible spring contact arms 82 of the left-hand terminal. Of course, as described above, the next succeeding pair of terminals lengthwise of the connector assembly will have the rigid contact portion 80 of the left-hand terminal engaging the flexible spring contact arms 82 of the right-hand terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly including a pair of hermaphroditic connectors having opposed mating faces which are juxtaposed generally along a plane when the connectors are mated, with the connectors being adapted for mating in either opposite direction generally parallel to said plane of the mating faces, each hermaphroditic connector comprising:

a housing including a plurality of spaced-apart ribs having edges extending from said plane and defining respective grooves between immediately adjacent ribs, the ribs of each hermaphroditic connector being interleaved with the ribs of the other connector when the two connectors are mated in said opposite direction, and complementary interengaging latch means on the housing to lock the connectors against unmating in a direction generally perpendicular to said plane of the mating faces; and a plurality of terminals mounted parallel to the ribs and the mating face on each housing and having contact portions of at least some of the terminals between the ribs for engaging the contact portions of the terminals on the housing of the other connector.

2. The electrical connector assembly of claim 1 wherein said complementary interengaging latch means comprise a hook on the housing of each hermaphroditic connector engageable with a complementary flange on the housing of the other connector.

3. The electrical connector assembly of claim 2 wherein the hook is at one end of the mating face of each connector and the flange is at an opposite end of the respective mating face.

4. The electrical connector assembly of claim 1 wherein alternating ones of said terminals have contact portions located at the edges of said ribs, with the contact portions of the other alternating terminals being located in said grooves.

5. The electrical connector assembly of claim 4 wherein said contact portions of the terminals are flexible.

6. The electrical connector assembly of claim 5, including anti-overstress portions of the housing behind at least some of the flexible contact portions of the terminals.

7. The electrical connector assembly of claim 5 wherein said terminals are stamped and formed of sheet metal material, and said flexible contact portions are bowed outwardly relative to said plane.

8. The electrical connector assembly of claim 1 wherein alternating ones of said terminals have flexible contact portions, with the contact portions of the other alternating terminals being rigid.

9. The electrical connector assembly of claim 8 wherein said terminals are stamped from sheet metal material.

10. The electrical connector assembly of claim 9 wherein said flexible contact portions comprise stamped spring arms.

11. The electrical connector assembly of claim 9 wherein said rigid contact portions comprise edges of the stamped terminals.

12. The electrical connector assembly of claim 11 wherein said flexible contact portions comprise stamped spring arms.

13. The electrical connector assembly of claim 8 wherein all said terminals are identical, with the flexible contact portions being at one end of the terminals and the rigid contact portions being at another end of the terminals.

14. The electrical connector assembly of claim 13 wherein said terminals are stamped from sheet metal material.

15. The electrical connector assembly of claim 14 wherein said flexible contact portions comprise stamped spring arms.

16. The electrical connector assembly of claim 14 wherein said rigid contact portions comprise edges of the stamped terminals.

17. The electrical connector assembly of claim 16 wherein said flexible contact portions comprise stamped spring arms.

18. The electrical connector assembly of claim 1 wherein said ribs are bifurcated to define slots for receiving contact portions of alternating ones of the terminals, with the contact portions of the other alternating terminals being located in said grooves.

19. The electrical connector assembly of claim 18 wherein the contact portions of said alternating ones of the terminals are rigid, and the contact portions of the other alternating terminals are flexible.

20. An electrical connector assembly including a pair of hermaphroditic connectors having opposed mating faces which are juxtaposed generally along a plane when the connectors are mated, with the connectors being adapted for mating in either opposite direction generally parallel to said plane of the mating faces, each hermaphroditic connector comprising:

a housing including a plurality of spaced-apart ribs extending from the plane having edges and defining respective grooves between immediately adjacent ribs, the ribs of each hermaphroditic connector being interleaved with the ribs of the other connector when the two connectors are mated in said either opposite direction; and a plurality of terminals mounted parallel to the ribs and the mating face on each housing with alternating ones of the terminals having contact portions located at the edges of said ribs, and with the other alternating terminals having contact portions located in said grooves.

21. The electrical connector assembly of claim 20 wherein said contact portions of the terminals are flexible.

22. The electrical connector assembly of claim 21, including anti-overstress portions of the housing behind at least some of the flexible contact portions of the terminals.

23. The electrical connector assembly of claim 21 wherein said terminals are stamped and formed of sheet metal material, and said flexible contact portions are bowed outwardly relative to said plane.

24. An electrical connector assembly including a pair of hermaphroditic connectors having opposed mating faces which are juxtaposed generally along a plane when the connectors are mated, with the connectors being adapted for mating in either opposite direction generally parallel to said plane of the mating faces, each hermaphroditic connector comprising:

a housing including a plurality of spaced-apart bifurcated ribs extending from said plane defining slots therein, the ribs defining respective grooves between immediately adjacent ribs, and the ribs of each hermaphroditic connector being interleaved with the ribs of the other connector when the two connectors are mated in said either opposite direction; and a plurality of terminals mounted parallel to the ribs and the mating face on each housing, with alternating ones of the terminals having contact portions in the slots of the bifurcated ribs, and with the other alternating terminals having contact portions located in said grooves.

25. The electrical connector assembly of claim 24 wherein the contact portions of said alternating ones of the terminals are rigid, and the contact portions of the other alternating terminals are flexible.

26. The electrical connector assembly of claim 25 wherein said terminals are stamped from sheet metal material.

27. The electrical connector assembly of claim 26 wherein said flexible contact portions comprise stamped spring arms.

28. The electrical connector assembly of claim 26 wherein said rigid contact portions comprise edges of the stamped terminals.

29. The electrical connector assembly of claim 28 wherein said flexible contact portions comprise stamped spring arms.

30. The electrical connector assembly of claim 25 wherein all said terminals are identical, with the flexible contact portions being at one end of the terminals and the rigid contact portions being at another end of the terminals.

* * * * *